US009657421B2

(12) United States Patent
Manzi et al.

(10) Patent No.: US 9,657,421 B2
(45) Date of Patent: May 23, 2017

(54) VERTICAL AXIS WASHING MACHINE

(71) Applicant: Whirlpool S.A., Sao Paulo (BR)

(72) Inventors: Guilherme Henrique Manzi, Sao Paulo (BR); Carlos E. Toledo, Sao Paulo (BR); Bruno T. Ramasco, Sao Paulo (BR)

(73) Assignee: Whirlpool, S.A., São Paulo, SP (BR)

( * ) Notice: Subject to any disclaimer, the term of this patent is extended or adjusted under 35 U.S.C. 154(b) by 628 days.

(21) Appl. No.: 14/104,219

(22) Filed: Dec. 12, 2013

(65) Prior Publication Data

US 2014/0157834 A1 Jun. 12, 2014

(30) Foreign Application Priority Data

Dec. 12, 2012 (BR) ..... 102012031682

(51) Int. Cl.
*D06F 13/02* (2006.01)
*D06F 17/10* (2006.01)
*D06F 39/08* (2006.01)

(52) U.S. Cl.
CPC ..... *D06F 13/02* (2013.01); *D06F 17/10* (2013.01); *D06F 39/083* (2013.01)

(58) Field of Classification Search
CPC ..... D06F 13/02; D06F 39/083; D06F 17/10
USPC ..... 68/132, 133
See application file for complete search history.

(56) References Cited

U.S. PATENT DOCUMENTS 2,449,634 A * 9/1948 Baade ..... D06F 13/02 137/602
2,574,418 A * 11/1951 Rubano ..... D06F 13/02 188/170
3,952,557 A 4/1976 Bochan
4,622,708 A * 11/1986 Gaelic ..... D06F 13/02 68/134
4,676,077 A * 6/1987 Hirooka ..... D06F 37/304 318/282
4,691,538 A * 9/1987 Shikamori ..... D06F 13/02 68/12.18
5,012,658 A * 5/1991 Shikamori ..... D06F 13/02 68/12.01
8,156,769 B2 4/2012 Leidig et al.

* cited by examiner

*Primary Examiner* — Joseph L Perrin
(74) *Attorney, Agent, or Firm* — Brian J. Colandreo; Michael T. Abramson; Holland & Knight LLP

(57) ABSTRACT

A vertical axis washing machine provided with a washing fluids drainage system whose washing fluids are suctioned into the agitator and then drained from the washing basket from its central—bottom opening. In particular, a vertical axis washing machine (1) wherein the agitator (3) provides a radial suction flow, through a surrounding wall (31) and an axial discharge flow through its lower end (32), the lower end (32) of the agitator (3) has a fluid communication with the drain hole (21) of the washing basket (2), and the drain hole (21) of the washing basket (2) has a fluid communication with the drain pump (4).

4 Claims, 3 Drawing Sheets

VERTICAL AXIS WASHING MACHINE

RELATED APPLICATION

This application claims priority to and the benefit of Brazilian Patent Application No. BR 10 2012 031682 0, filed Dec. 12, 2012, the entire disclosure of which is incorporated herein by reference in its entirety.

FIELD OF THE INVENTION

The present invention relates to a vertical axis washing machine, and more particularly a vertical axis washing machine provided with a washing fluids drainage system whose washing fluids are suctioned into the agitator and then drained from the washing basket from its central-bottom opening.

In this regard, it is noted that, according to this invention, the washing fluid (dirty water, water with washing supplies and clean water) tends to flow across the whole inside of the agitator before being drained out of the washing basket, wherein said drainage occurs through a single focal point (disposed at the bottom of the washing basket) that is aligned to the bottom end of said agitator.

BACKGROUND OF THE INVENTION

As commonly known by a person skilled in the art, vertical axis washing machines, which are also known as "top load" washing machines, comprise electromechanical rotating machines able to develop at least one washing cycle comprised of filling steps, washing steps, draining steps and centrifugation steps.

According to the extensive literature available, thus belonging to the current state of the art, it can be noted that conventional embodiments of vertical axis washing machines comprise at least one washing basket for the reception of the wash load (clothes and other textile articles) and washing fluids.

Furthermore, conventional washing baskets also provide, in its interior, the existence of a kind of hollow column whose outer face is provided with ribs, blades, or walls that help to wash, by friction, the wash loads. Said hollow column is technically known as agitator.

Since the agitator is hollow, it is common to use its interior for the purpose of circulating the washing fluid.

In this regard, it is also common to use filter elements within the agitator. This allows that the washing fluid, throughout its movement inside the agitator, can be simultaneously filtered with the execution of the washing steps.

In general, during the washing steps, the washing fluid circulation is continuous, as follows: the washing fluid contained in the washing basket is inserted into the agitator (through the top of the agitator), passing through the filter element. Then, the washing fluid is reinserted into the washing basket (through the bottom of the agitator). In this flow circulation of the washing fluid, during the washing steps, the interior of the agitator is used as a kind of filter chamber.

In the draining steps, as seen in the embodiments of currently existing vertical axis washing machines, the agitator and its filter element are not used.

This is because, in conventional embodiments of vertical axis washing machines, drainage of washing fluid occurs through holes arranged in the bottom of the washing basket.

One example of a conventional drainage system can be found in the patent document U.S. Pat. No. 3,952,557, which discloses a vertical axis washing machine integrated with a drainage system in which the washing fluid is drained through holes present in the bottom of the basket. In this particular case, it is further noted that the agitator has no hole for the passage of water therein.

Although the embodiment described in the patent document U.S. Pat. No. 3,952,557 does not provide any type of drain pump, it is noteworthy that the latest embodiments provide the use of hydraulic pumps connected to the holes provided in the bottom of the washing basket. In this case, the hydraulic pumps act as drain pumps, and accelerate the drainage of the washing fluids. Furthermore, as known by a person skilled in the art, the introduction of drain pumps in drainage systems allow the bottom of the wash tank not be substantially flat (as disclosed in the exemplification of the patent document U.S. Pat. No. 3,952,557).

The current state of the art also includes alternative construction of drainage systems. In this context, it is worth mentioning the patent document U.S. Pat. No. 8,156,769, which discloses a vertical axis washing machine which has washing basket, and lower drain holes, drainage channels disposed in the side walls of the washing basket.

Anyway, drainage systems of washing fluids in vertical axis washing machines, using the internal volume of the agitator and, mainly, using the filter element usually existing inside the agitator are not known.

The present utility model patent arises based on this context.

OBJECTIVES OF THE INVENTION

Thus, it is one of the objectives of this invention to present a vertical axis washing machine able to use the filter aspects of the filter means disposed within the agitator, in draining steps of the washing fluid.

Accordingly, it is one objective of this invention that the main drainage of the vertical axis washing machine occurs through the agitator and more particularly, through the lower end of the agitator.

It is also one objective of this invention that said drainage occurs through a single hole provided in the center of the bottom region of the washing basket.

Finally, it is still one of the objectives of this invention to reveal fluid communication means between the center of the single hole disposed in the center of the bottom region of the washing basket and a possible drain pump.

SUMMARY OF THE INVENTION

These and other objectives of the invention disclosed herein are fully achieved by the vertical axis washing machine disclosed herein, which comprises at least one washing basket provided with at least one drain hole, at least one agitator disposed within the washing basket and at least one drain pump.

In general, said vertical axis washing machine disclosed herein differs from other washing machines belonging to the current state of the art by the fact that said agitator provides a radial suction flow through a surrounding wall, and an axial discharge flow through its lower end. Furthermore, the lower end of the agitator has fluid communication with the drain hole of the washing basket, and the drain hole of the washing basket has fluid communication with the drain pump.

Preferably, the fluid communication between the lower end of the agitator and the drain hole of the washing basket is performed by a hydraulic connector and, more particularly, the fluid communication between the lower end of the agitator and the drain hole of the washing basket and the fluid communication between the drain hole of the washing basket and the drain pump are performed by the same hydraulic connector.

According to the preferred embodiment of the invention, said hydraulic connector comprises a structural body essentially defined by at least two ends and at least one channel disposed between said ends.

Preferably, the hydraulic connector is disposed within the washing basket which may comprise one modular structural body, or a structural body shaped in the bottom plate of the washing basket.

BRIEF DESCRIPTION OF THE DRAWINGS

The present invention will be described in detail based on the figures listed below, including.

DETAILED DESCRIPTION OF THE INVENTION

As previously mentioned, it is one of the main objectives of the invention that the drain flow of the washing fluid to be suctioned by a suction pump, occurs from inside the agitator, which has fluid communication with the bottom of the washing basket which, in turn has fluid communication with said suction pump.

It is worth noting that the term "fluid communication" refers to the fact that these elements define a fundamentally continuous hydraulic circuit.

Particularly in this case, the "fluid communication" between the agitator and the bottom of the washing basket means that the washing fluid, once introduced into the agitator, can be directed to the bottom of the washing basket. The "fluid communication" between the bottom of the washing basket and the drain pump means that the washing fluid, once present in the bottom of the washing basket, can be directed to the drain pump.

The main idea of this invention is to centralize the drain flow of water in a single hole of the washing basket. Besides, the idea can be used to promote the filtering of all this washing fluid (prior to drainage) inside the agitator. Accordingly, the agitator, besides of providing the filtering of the washing fluid, further allows the direction (inside the washing basket itself) of the drain flow of the washing fluid.

This idea is especially suitable for vertical axis washing machines devoid of water storage tank, or washing machines whose washing fluid is disposed only within a single washing basket.

Figure 1:
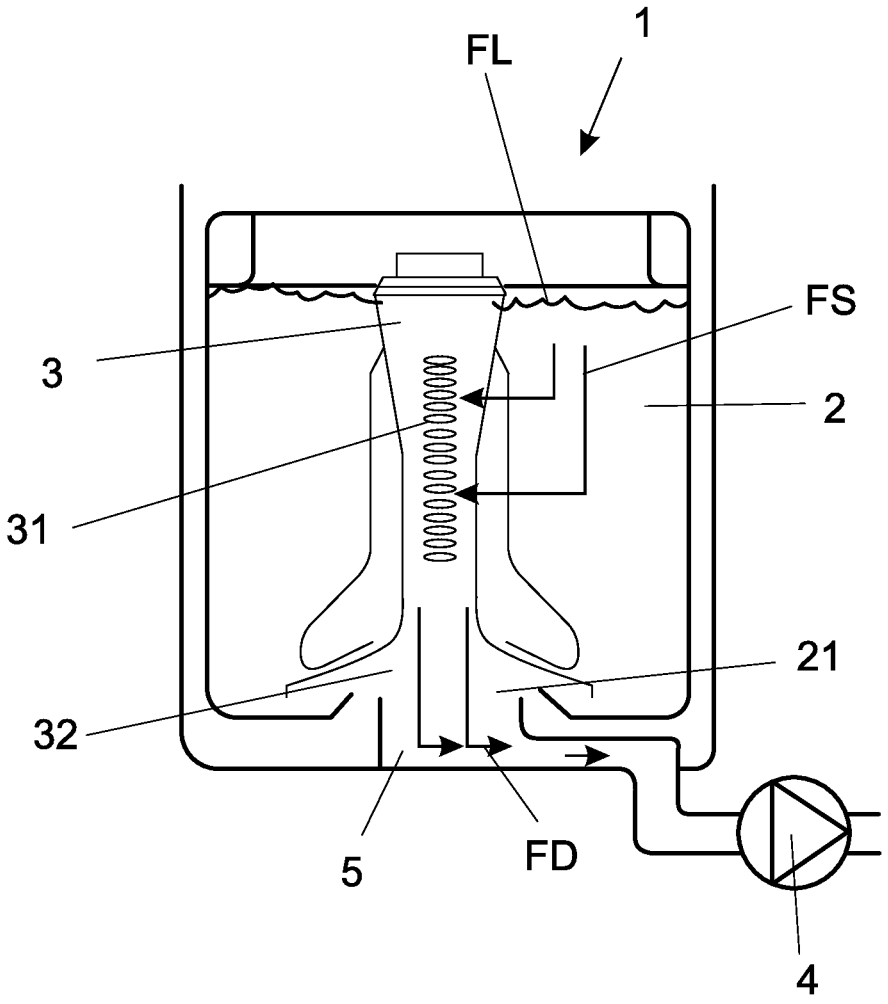
FIG. 1 schematically illustrates a vertical axis washing machine in accordance with this invention.

FIG. 1 illustrates, in schematic form, the main idea of this invention. In this figure, it is illustrated a vertical axis washing machine 1 essentially integrated by a washing basket 2, by an agitator 3 and a drain pump 4.

Evidently, said washing machine 1 is also provided with all the other electromechanical systems inherent to its operation, however, for practical issues, such systems will not be illustrated or described, after all, these are already known by a person skilled in the art.

Said washing basket 2 comprises a primarily conventional washing basket, being free of holes in its surrounding wall, and having a single drain hole 21 centrally disposed in its lower plate.

Said agitator 3 also comprises a fundamentally conventional agitator, having through holes disposed in its surrounding wall 31 and a lower end 32 fundamentally opened.

The drain pump 4 also comprises a conventional and widely known drain pump by a person skilled in the art.

The merits of this invention, also in accordance with FIG. 1, refers to the fact that the washing machine 1 comprises a novel drainage hydraulic circuit, where the lower end 32 of the agitator 3 has fluid communication with the drain hole 21 of the washing basket 2 and the drain hole 21 of the washing basket 2 has fluid communication with the drain pump 4.

This fluid communication ultimately defines that in the agitator 3, the suction flow SF will be radial (through its surrounding wall 31) and the discharge flow DF will be axial (through its lower end 32).

Consequently, these fluid communications achieve three fundamental advantages over washing machines belonging to the current state of the art.

The first advantage is related to the fact that if the agitator 3 provides a filter element in its interior, all the washing fluid WF tends to be filtered before being drained out. This feature is extremely beneficial concerning the reuse of said washing fluid WF.

The second advantage is related to the fact that it is no longer necessary to use water storage tanks to help draining the washing basket.

The third advantage is related to the creation of a specific draining "point", which is provided through the inside of the agitator. Consequently, the drained washing fluid WF is still free of turbulence (present in conventional drainages) that can disrupt the washing performance.

Figure 2:
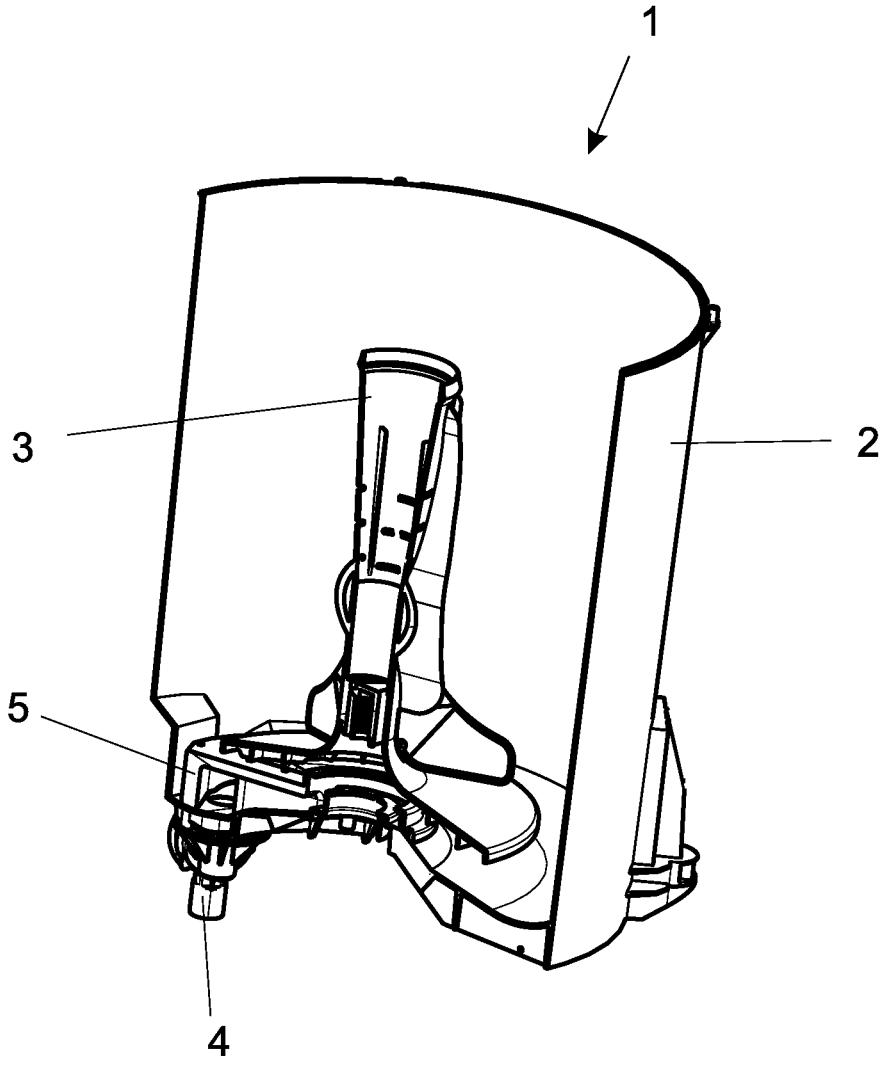
FIG. 2 schematically illustrates a preferred embodiment of this invention.
Figure 3:
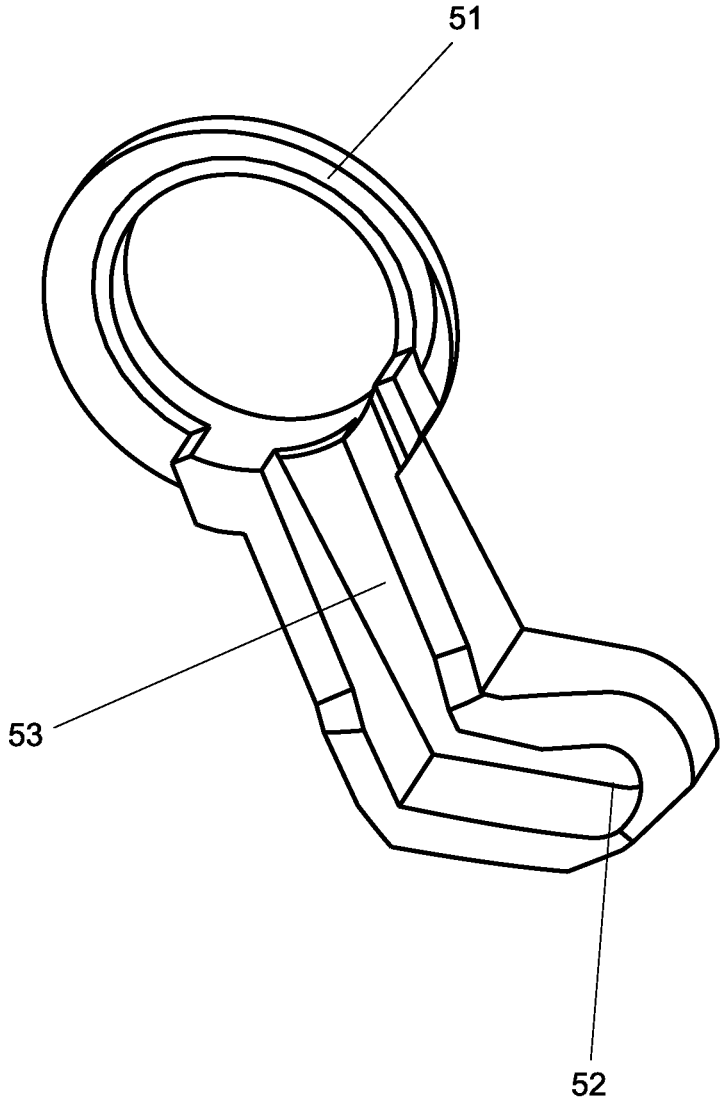
FIG. 3 illustrates, in isometric perspective, the hydraulic connector belonging to the preferred embodiment of this invention.

A preferred embodiment of a vertical axis washing machine 1 according to the present invention is schematically illustrated in FIGS. 2 and 3.

In FIG. 2, it can be seen that it is possible to obtain a single fluid communication between the lower end 32 of the agitator 3, the drain hole 21 of the washing basket 2 and the drain pump 4 through the use of a single hydraulic connector 5.

In this preferred embodiment, and as illustrated in FIG. 3, it is seen that the hydraulic connector 5 comprises a monobloc body provided with an annular end 51 and an opposite end 52, said ends being interconnected by a channel 53.

In this embodiment, the lower end 32 of the agitator 3 and the drain hole 21 of the washing basket 2 (as shown in FIG. 1).

Consequently, the size of the hydraulic connector 5 is able to fluidly connect the lower end 32 of the agitator 3 (centrally disposed relative to the washing basket 2) to the drain hole 21 (circumferentially arranged relative to the washing basket 2). It was also observed that the hydraulic connector 5 is disposed inside the washing basket 2.

Also in this case, it appears that the drain pump 4 is installed immediately below the drain hole 21, being attached to the outside of the washing basket 2.

This preferred embodiment allows all the fluid communications to remain inert, even in occasions where the washing basket 2 or the agitator 3 are in motion.

Even though it has only been described a preferred embodiment of this invention, it should be understood that the scope thereof covers other possible variations, which are limited solely by the content of the claims, including the possible equivalents means therein.

The invention claimed is:

1. A vertical axis washing machine, comprising:

at least one washing basket provided with at least one drain hole;

at least one agitator arranged inside the washing basket, and at least one drain pump;

wherein:

said agitator provides a radial suction flow through its surrounding wall and an axial discharge flow through its lower end;

the lower end of the agitator has a fluid communication with the drain hole of the washing basket;

the drain hole of the washing basket has a fluid communication with the drain pump;

the fluid communication between the lower end of the agitator and the drain hole of the washing basket and the fluid communication between the drain hole of the washing basket and the drain pump are performed by the hydraulic connector; and said hydraulic connector comprises a structural body defined by at least two ends and at least one channel disposed between said ends.

2. The vertical axis washing machine according to claim 1, the hydraulic connector is disposed inside the washing basket.

3. The vertical axis washing machine according to claim 1, the hydraulic connector comprises a modular structural body.

4. The vertical axis washing machine according to claim 1, the hydraulic connector comprises a structural body disposed in the inside of the washing basket.

* * * * *